US005533879A

United States Patent [19]

Chen

[11] Patent Number: 5,533,879

[45] Date of Patent: Jul. 9, 1996

[54] MANUAL DRIVEN VALVED PISTON RECIPROCATING LIQUID PUMP

[76] Inventor: Kuo N. Chen, 1F, 125-6, Sec: 1, San Min Rd., Taichung, Taiwan

[21] Appl. No.: 419,466

[22] Filed: Apr. 10, 1995

[51] Int. Cl.[6] ..... F04B 53/12

[52] U.S. Cl. ..... 417/553; 417/569; 92/169.1; 92/144; 92/164

[58] Field of Search ..... 417/545, 555.1, 417/553, 569; 92/169.1, 144, 164

[56] References Cited

U.S. PATENT DOCUMENTS

| | | | |
|---|---|---|---|
| 855,647 | 6/1907 | Mallonee | 417/553 |
| 2,931,313 | 4/1960 | Hughes | 417/569 |
| 3,018,779 | 1/1962 | Tyler et al. | 417/553 |
| 3,260,217 | 7/1966 | Thresher | 417/569 |
| 5,192,001 | 3/1993 | Bianco | 417/415 |

FOREIGN PATENT DOCUMENTS

| | | | |
|---|---|---|---|
| 1000914 | 10/1951 | France | 417/569 |
| 445 | of 1900 | United Kingdom | 417/555.1 |

*Primary Examiner*—Charles Freay
*Assistant Examiner*—Roland G. McAndrews, Jr.

[57] ABSTRACT

A liquid pump comprises an insulated cylinder which is provided with a top seat and a bottom seat. The top seat is provided with a liquid inlet while the bottom seat is provided with a liquid outlet. A piston rod is fastened with the top seat and is provided at the bottom thereof with a one-way piston valve device capable of creating a vacuum in an upper chamber of the cylinder. The bottom seat comprises a receiving space in which a one-way valve device is disposed. The liquid contained in a vessel is drawn up by suction via the liquid inlet. The liquid so drawn up is discharged via the liquid outlet.

1 Claim, 7 Drawing Sheets

MANUAL DRIVEN VALVED PISTON RECIPROCATING LIQUID PUMP

FIELD OF THE INVENTION

The present invention relates generally to a liquid pump, and more particularly to a liquid pump capable of withstanding a great strain.

BACKGROUND OF THE INVENTION

As shown in FIG. 1, a prior art liquid pump is capable of drawing liquid up by suction created by a manually-operated piston fitted into the cylinder. Such a prior art liquid pump as described above is rather primitive in construction and is therefore rather inefficient.

Another prior art liquid pump is shown in FIG. 2 and is provided with a pressure ball capable of creating a suction force to draw liquid up via a one-way movable gate. Such a conventional liquid pump as described above is limited in design n that it is not suitable for use in drawing up a heavy liquid having a high viscosity.

SUMMARY OF THE INVENTION

It is therefore the primary objective of the present invention to provide a heavy-duty pump capable of creating a strong suction force to draw up liquid effectively.

It is another objective of the present invention to provide a heavy-duty pump which is intended for use in various industries and is so well insulated as to provide a user thereof with protection.

In keeping with the principle of the present invention, the foregoing objectives of the present invention are attained by a heavy-duty liquid pump comprising an insulated cylinder which is provided at the top thereof with the top seat of a piston rod and at the bottom thereof with the bottom seat of a tread ring. The top seat is provided with a liquid inlet while the bottom seat is provided with a liquid outlet. The piston rod is provided at the bottom thereof with a one-way piston valve device. The bottom seat comprises a receiving space in which a one-way valve device is disposed. The liquid contained in a vessel is drawn in via the liquid inlet. The liquid so drawn in is then let out via the liquid outlet.

The foregoing objectives, features and advantages of the present invention will be more readily understood upon a thoughtful deliberation of the following detailed description of the present invention in conjunction with, the accompanying drawings.

DETAILED DESCRIPTION OF THE EMBODIMENTS

Figure 1:
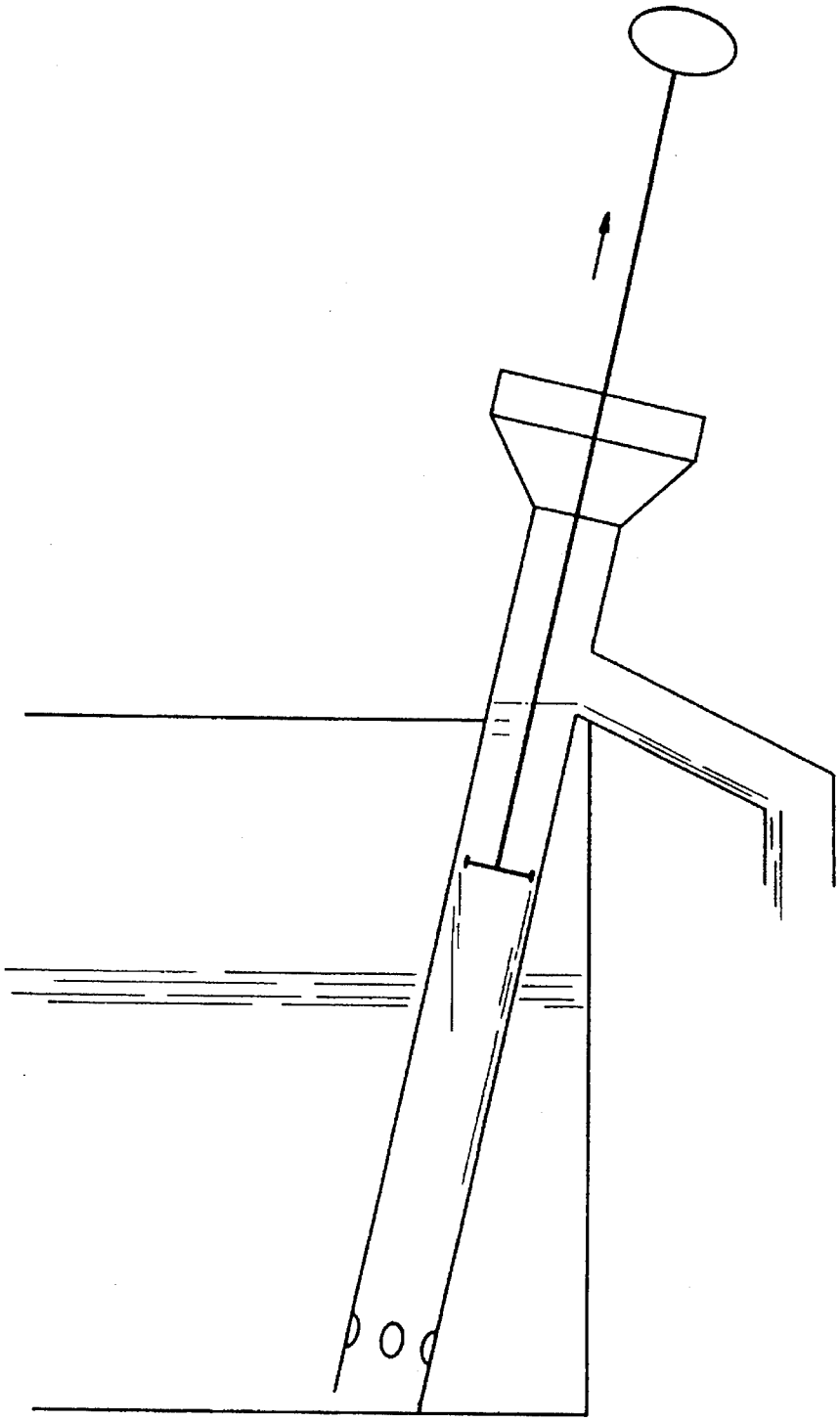
FIG. 1 shows a schematic view of a prior art liquid pump.
Figure 2:
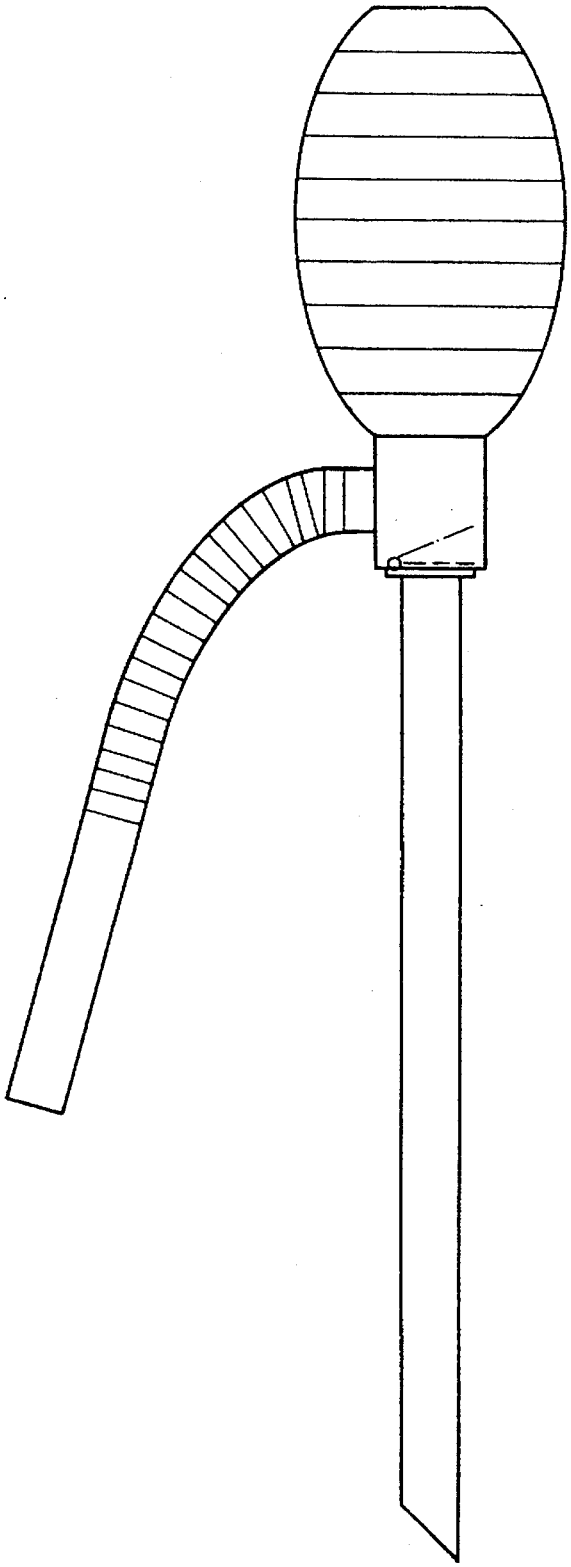
FIG. 2 shows a schematic view of another prior art liquid pump.
Figure 3:
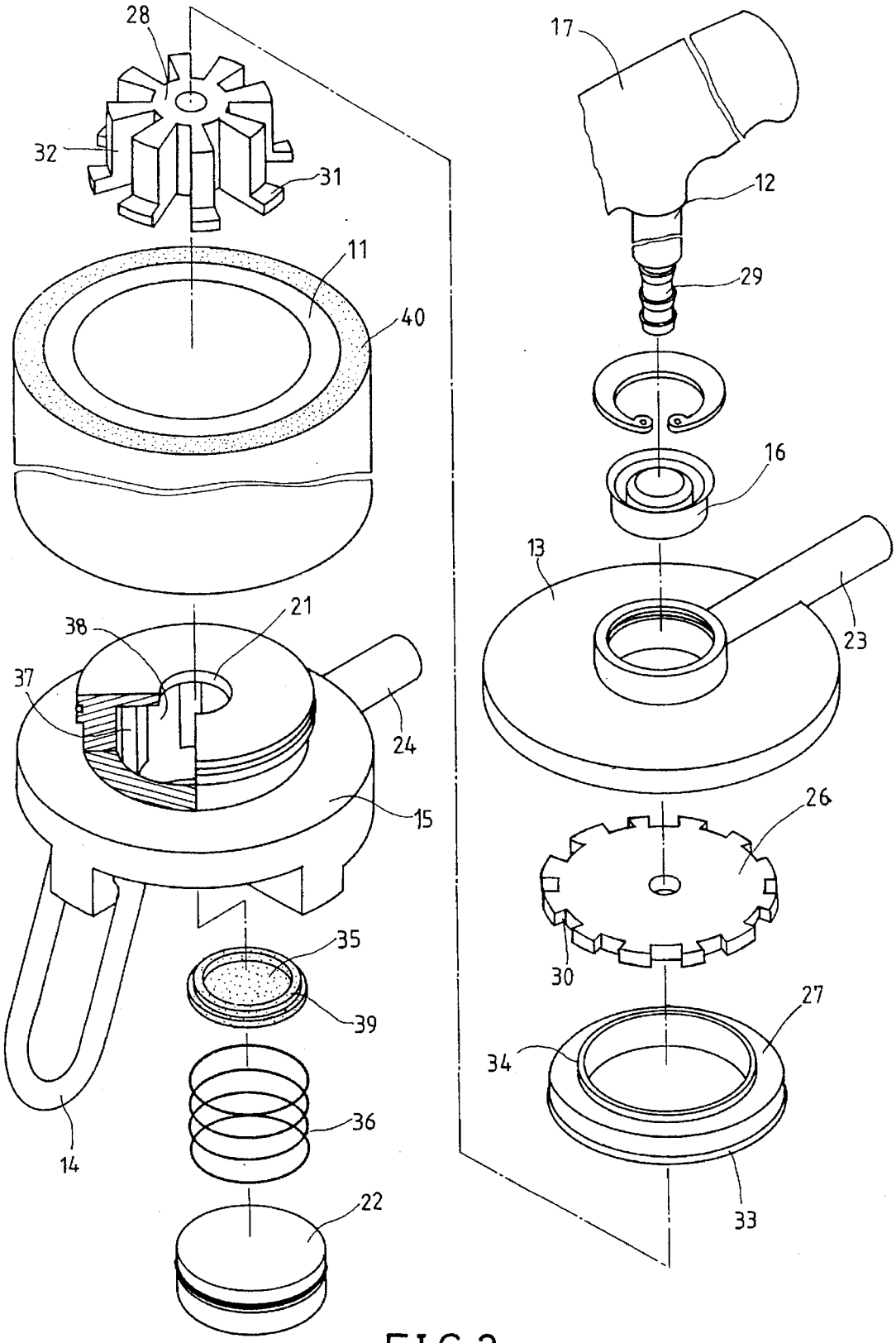
FIG. 3 shows an exploded view of a liquid pump of the present invention.
Figure 4:
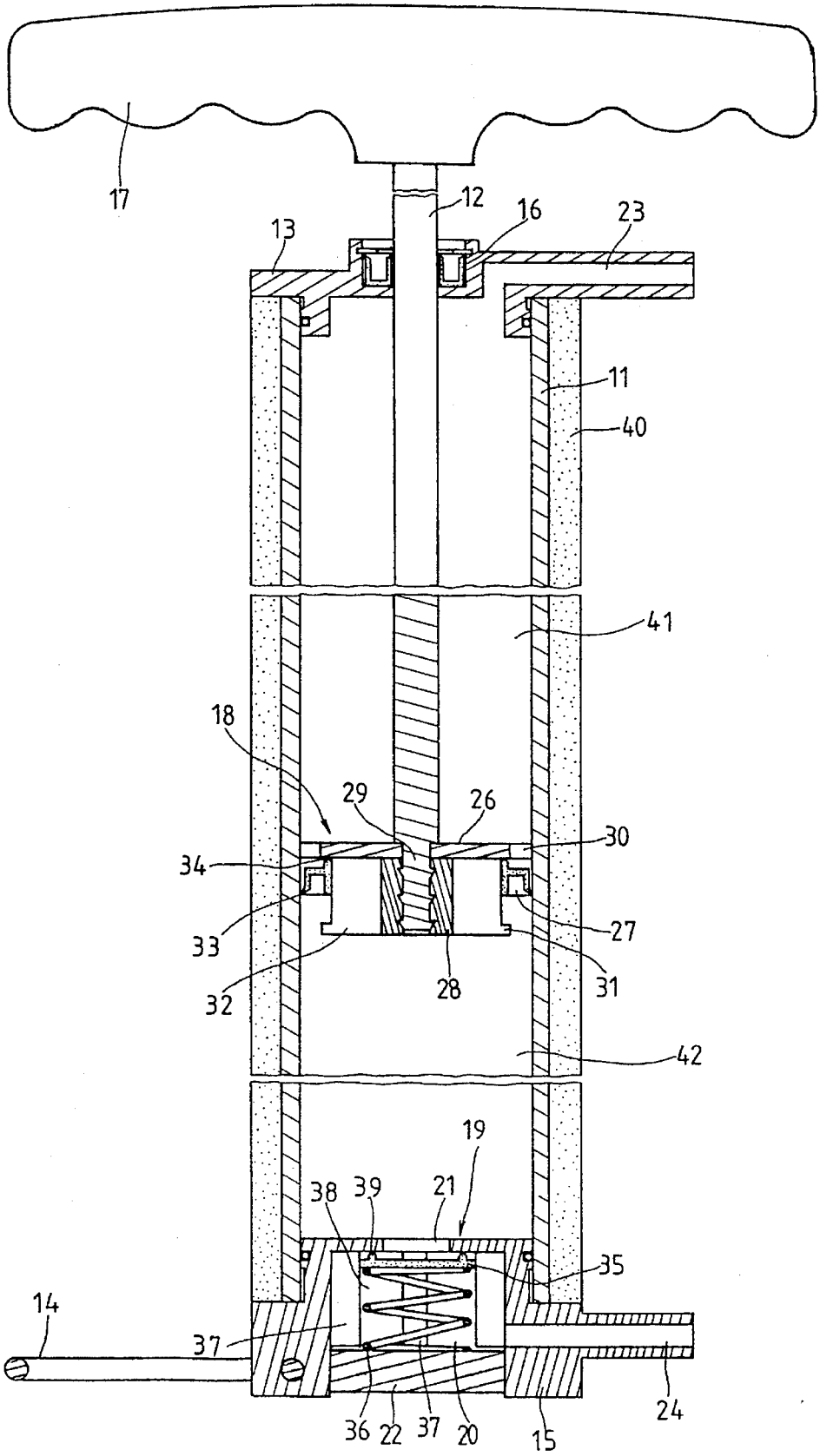
FIG. 4 shows a sectional view of the liquid pump combination according to the present invention.

As shown in FIGS. 3 and 4, a liquid pump embodied in the present invention comprises a cylinder 11, which is provided at the top thereof with a top seat 13 of a piston rod 12 and at the bottom thereof with a bottom seat 15 having a tread ring 14 fastened thereto. The top seat 13 is provided centrally with a seal 16 which is fitted over the piston rod 12 having at the top thereof a handle 17 and further having at the bottom thereof a one-way piston valve device 18. The bottom seat 15 comprises a receiving space 20 in which a one-way valve device 19 is disposed. The receiving space 20 is provided at the top thereof with a through hole 21 and at the bottom thereof with a plug 22. The top seat 13 is further provided with a liquid inlet 23 engageable with extension tube 25 while the bottom seat 15 is further provided with a liquid outlet 24 engageable with another extension tube. The one-way piston valve device 18 comprises a slotted ring 26, a slidable seal 27, and a guide body 28, which are fitted respectively and sequentially over a lower end 29 of the piston rod 12. The slotted ring 26 is provided peripherally with a plurality of slots 30 and is fitted snugly into the cylinder 11. The guide body 28 is provided at the bottom thereof with a plurality of projections 31 and is further provided longitudinally with a plurality of guide slots 32. The slidable seat 27 is located between the slotted ring 26 and the projections 31 of the guide body 28 such that the outer edge 33 of the slidable seat 27 is in a close contact with the inner wall of the cylinder 11, and that the circular protruded edge 34 is located under the slotted ring 26. The one-way valve device 19 is composed of a gate piece 35, a coil spring 36 and a plurality of ribs 37 arranged circularly. The receiving space 20 is provided in the inner wall thereof with and a plurality of channels 38. The gate piece 35 is urged by the coil spring 36 such that the periphery of the gate piece 35 is in contact with the ribs 37, and that the through hole 21 of the receiving space 20 is sealed off by the circular top edge 39 of the gate piece 35. The cylinder 11 is provided longitudinally in the periphery thereof with a heat insulating layer 40 for providing a user of the liquid pump of the present invention with protection.

In operation, the one-way piston valve device 18 located at the bottom of the piston rod 12 is pulled upwards with a hand holding the handle 17, as indicated in FIG. 5A, so as to cause the slidable seal 27 to located on the projection 31 of the guide body 28. As a result, the air in the upper compartment 41 of the cylinder 11 is compressed by the one-way piston valve device 18 and is caused to flow into the lower compartment 42 of the cylinder 11 via the slots 30 of the slotted ring 26, a gap between the underside of the slotted ring 26 and the circular protruded edge 34 of the slidable seal 27, and the guide slots 32 of the guide body 28. As the one-way piston valve device 18 is pushed downwards, as illustrated in FIG. 5B, the slidable seal 27 is caused to move upwards such that the circular protruded edge 34 of the slidable seal 27 is in contact with the underside of the slotted ring 26, thereby resulting in the flow paths between the slots 30 and the guide slots 32 to be sealed off completely so as to bring about a piston effect. As a result, the air in the lower compartment 42 of the cylinder 11 is so compressed as to force the gate piece 35 and the coil spring 36 of the one-way valve device 19 to move downwards. The compressed air is let out from the liquid outlet 24 via the through hole 21, the gaps between the underside of the through hole 21 and the circular top edge 39 of the gate piece 35, and the channels 38. In the meantime, the upper compartment 41 of the cylinder 11 is completely exhausted of air, thereby causing the liquid held in a container (not shown in the drawing) to be drawn up by suction to enter the upper compartment 41 of the cylinder 11 via the liquid inlet 23.

As illustrated in FIG. 6A, the one-way-piston valve device 18 is moved upwards so as to cause the gate piece 35 to move upwards. In the meantime, the one-way valve device 19 causes the lower compartement 42 of the cylinder 11 to be completely exhausted of air while the slidable seal 27 is caused instantly to slide downwards to permit the liquid held in the upper compartment 41 to flow to the lower compartment 42. When the one-way piston valve device 18 is caused by the piston rod 12 to move downwards, as shown in FIG. 6B, the liquid held in the container is drawn up by suction created by the upper compartment 41 to enter the upper compartment 41 via the liquid inlet 23. In the meantime, the liquid held in the lower compartment 42 is discharged via the liquid outlet 24. The liquid pump of the present invention is therefore suitable for use in pumping the liquid having a high viscosity and a high specific gravity.

Figure 5:
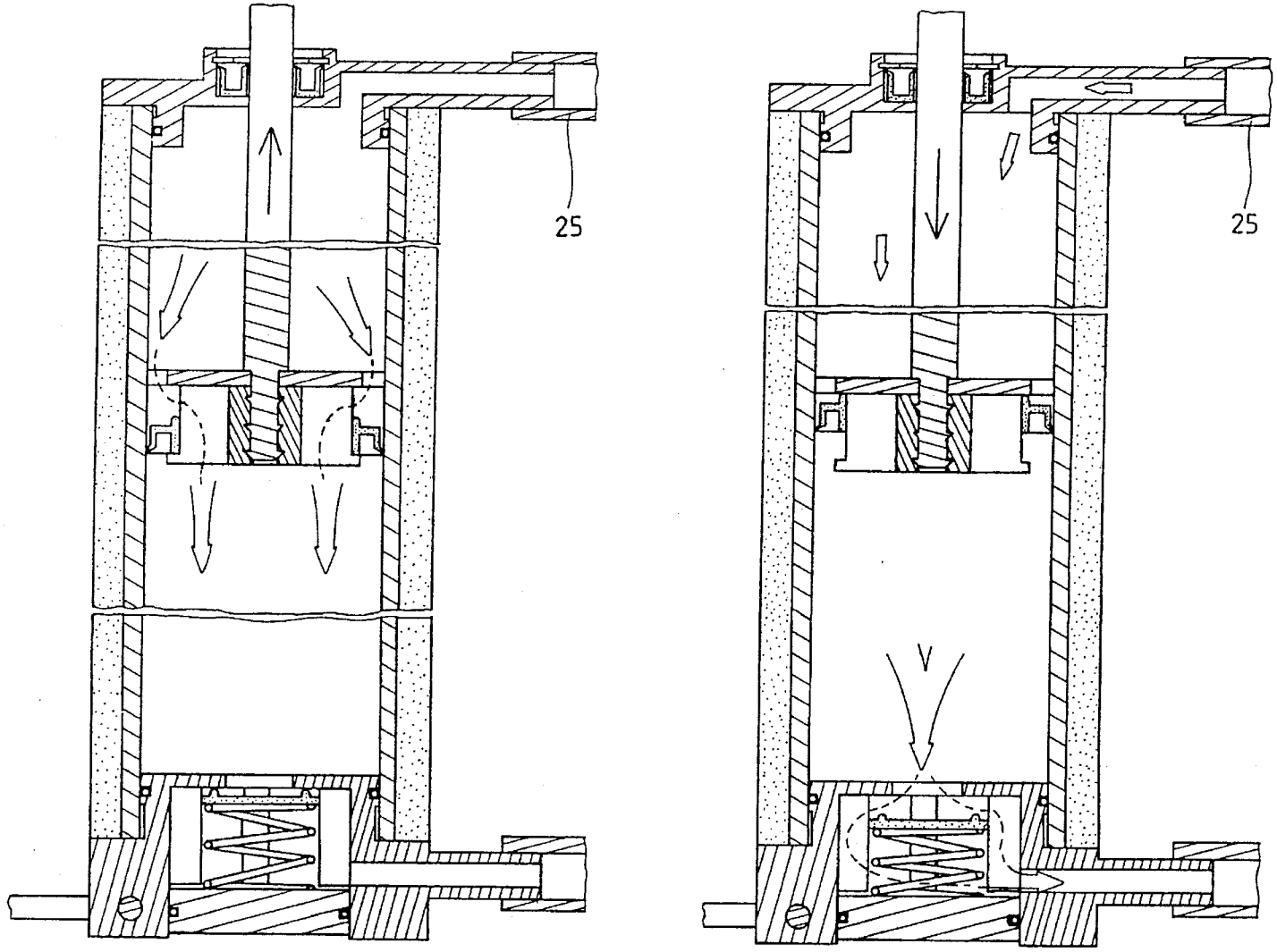
FIG. 5 shows a schematic view of the liquid pump in action according to the present invention.
Figure 6:
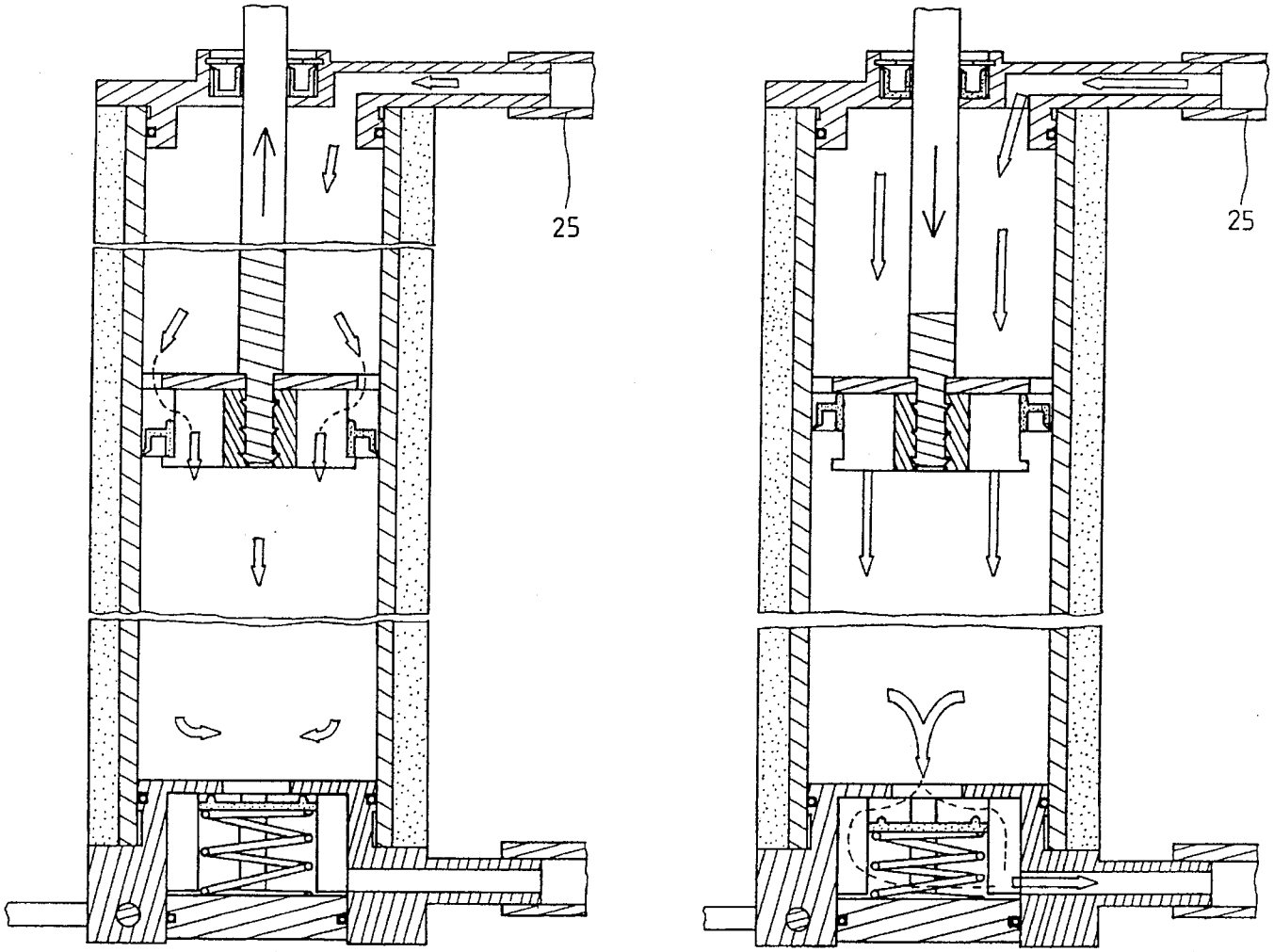
FIG. 6 shows another schematic view of the liquid pump in action according to the present invention.
Figure 7:
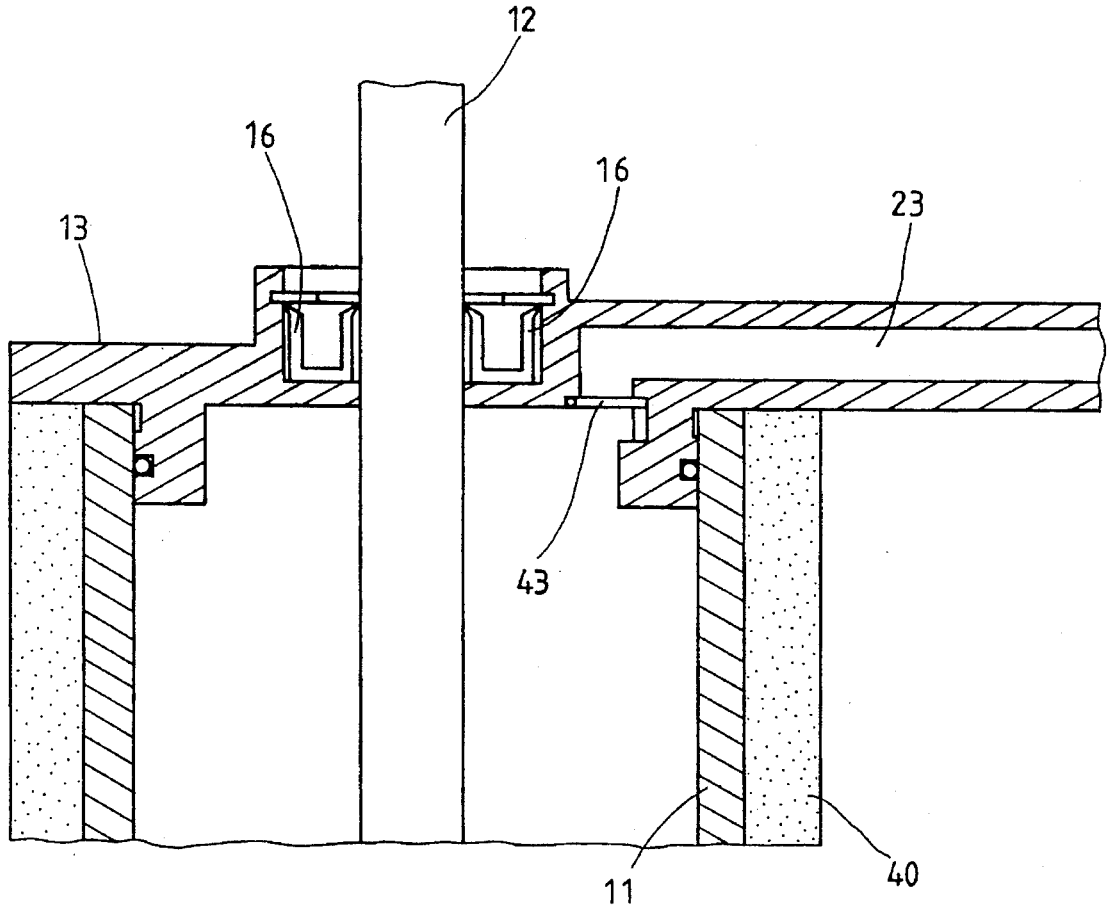
FIG. 7 shows a schematic view of another preferred embodiment of the present invention.

As shown in FIGS. 5 and 6, the inlet 23 of the liquid pump of the present invention is fastened with one end of the extension tube 25 which is sufficiently long to allow another end thereof to reach the bottom of the container in which liquid is held. In addition, the liquid pump of the present invention is suitable for use in pumping a hot liquid by virtue of the fact that the cylinder 11 of the present invention comprises the heat insulating layer 40 capable of providing a user of the liquid pump with protection. As shown in FIG. 7, the liquid pump of the present invention is further provided with a check valve 43, which is located at the inner opening of the liquid inlet 23 and is intended to prevent the liquid held in the pump from flowing in reverse when the one-way piston valve device 18 is moved upwards.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A manual valved piston reciprocating liquid pump comprising:

a cylinder of a hollow construction and provided at a top thereof with a top seat and at a bottom thereof with a bottom seat having therein a receiving space, said cylinder further provided therein an upper compartment and a lower compartment, said cylinder still further provided peripherally with an insulation layer;

a piston rod held securely by said top seat of said cylinder such that an upper end of said piston rod is fastened with a handle, and that a lower portion of said piston rod is located in said upper compartment of said cylinder and is provided at a bottom thereof with a one-way piston valve device capable of creating a vacuum in said upper compartment of said cylinder;

a one-way valve device disposed in said receiving space of said bottom seat;

a liquid inlet located at one side of a top end of said cylinder and communicating with said upper compartment of said cylinder, said liquid inlet being engageable at an outer end thereof with an extension hose, said liquid inlet provided at an inner end thereof with a check valve capable of preventing liquid held in said upper compartment from flowing back into said liquid inlet when said one-way piston valve device is actuated to move upwards; and a liquid outlet located at one side of a bottom end of said cylinder and communicating with said lower compartment of said cylinder, said liquid outlet being engageable at an outer end thereof with an extension hose;

wherein said one-way piston valve device comprises:

a slotted ring fastened to a lower end portion of said piston rod such that said slotted ring is peripherally and snugly in contact with an inner wall surface of said cylinder, said slotted ring further provided peripherally with a plurality of slots;

a slidable seal located under said slotted ring such that said slidable seal is peripherally in contact with said inner wall surface of said cylinder, said slidable seal provided on an upper edge thereof with a circular projection; and a guide body fastened to said lower end portion of said piston rod such that said guide body is located radially within said slidable seal, said guide body provided peripherally at a bottom thereof with a plurality of projections spaced equidistantly, said guide body further provided longitudinally with a plurality of guide slots;

wherein said one-way valve device comprises:

a gate piece having a periphery fastened slidably on a plurality of ribs arranged circularly on an inner wall of said receiving space of said bottom seat, said gate piece further having peripherally on an upper surface thereof a circular protruded edge; and a biasing means disposed in said receiving space such that said gate piece is urged by an upper end of said biasing means, and that a lower end of said biasing means is urged by a plug disposed at a bottom of said receiving space.

* * * * *